US005792542A

United States Patent [19]

Morgon

[11] Patent Number: 5,792,542

[45] Date of Patent: Aug. 11, 1998

[54] FIRE RETARDING FLUID MAT

[76] Inventor: Terence L. Morgon, 3714 E. 4th St., Long Beach, Calif. 90814

[21] Appl. No.: 835,373

[22] Filed: Apr. 7, 1997

[51] Int. Cl.[6] ..... B32B 3/06

[52] U.S. Cl. ..... 428/102; 2/243; 5/456; 5/457; 428/68; 428/72; 428/73; 428/920; 428/921

[58] Field of Search ..... 428/68, 72, 73, 428/76, 920, 921, 102; 5/456, 457; 2/243

[56] References Cited

U.S. PATENT DOCUMENTS

| | | | |
|---|---|---|---|
| 3,577,305 | 5/1971 | Hines | 428/72 |
| 3,640,831 | 2/1972 | Gardner | 428/72 |
| 4,520,054 | 5/1985 | Pfeiffer | 428/72 |
| 5,405,671 | 4/1995 | Kamin | 428/72 |

*Primary Examiner*—Nasser Ahmad
*Attorney, Agent, or Firm*—Dennis W. Beech

[57] ABSTRACT

The fire retarding fluid mat is formed of two layers of material sealed around the edges. At least one layer intended for exposure to burning materials is a fire layer of semiporous material which is covered on the outer surface by a semiporous coating. The second or container layer is composed of a semiporous or nonporous material. The two layers are seamed together at joints intermediate the edges to prevent a ballooning effect when the mat is filled with a fluid such as water. When burning material contacts the semiporous coating fluid is released by capillary action. Once the fire is extinguished the semiporous coating reseals to retain the fluid.

8 Claims, 2 Drawing Sheets

FIRE RETARDING FLUID MAT

BACKGROUND OF THE INVENTION

1. Field of the Invention. This invention relates to devices used to control or extinguish fires. The new device provides a simple means to cover or protect an object or person from burning embers and contains a fluid such as water which is released to extinguish burning materials. The device is normally constructed in the form of a mat which contains a fluid.

2. Description of Related Art. There are currently in use various mats, covers, blankets, etc. which have been chemically treated with a fire retardant chemical. Such covers are used where there would be danger from fire such as with small children. Even clothing and building materials and furniture may be treated with fire retardant chemicals for safety purposes. In general all of these articles are intended to retard the rapid burning of the article chemically treated.

Other articles such as a firefighter's coat or covers used by forest firefighters are intended for temporary protection from burning materials and to some extent the heat of a fire. However, such protective clothing and covers become hot themselves with prolonged exposure to fire and heat. In addition while they may be designed to retard their burning, the article does not act to extinguish burning material which may come into contact with the article.

The present invention provides a straight forward method to protect objects and persons from burning materials even in the event the burning materials are directly in contact with the mat. The fire retarding fluid mat uses multiple layers of material joined at the edges and sectioned internally to form a mat which may be filled with a fluid such as water. At least one layer of the mat is a semiporous material treated on its outside surface with a semiporous coating. The semiporous nature of the mat allows the internal fluid to escape by a capillary action when heat, such as, created by burning material against the mat, conditions occur. The escaping fluid acts to extinguish the fire. In addition, the evaporation process causes the layer opposite the semiporous layer to temporarily cool due to the temperature differential.

SUMMARY OF THE INVENTION

A primary object of the present invention is to provide a mat composed of elements which retard the burning of materials which contact the mat. A further object is to provide a mat wherein a relatively cooler surface occurs on the side opposite the surface which is in contact with the burning materials. Another object is to provide the mat construction such that it may be formed in different configurations such as for protective clothing.

In accordance with the description presented herein, other objectives of this invention will become apparent when the description and drawings are reviewed.

DESCRIPTION OF THE PREFERRED EMBODIMENT

The fire retarding fluid mat consists of a fluid container shaped normally as a relatively flat mat form. However, it may be constructed in shapes such as clothing to be worn for protection from fire. The mat provides a shield or barrier for fire protection of flammable or nonflammable surfaces. The mat can be quickly deployed to protect buildings, equipment and people. Only relatively small amounts of fluid such as water are required to fill the mat and the capillary action to allow fluid to escape to retard any fire conserves water usage.

The mat has at least two layers of material with at least one layer of material being semiporous wherein the opposite layer may be nonporous or semiporous.

The mat will normally be sectioned by connecting the surfaces at discrete points to prevent a balloon effect when the mat is filled with a fluid. The mat has a fluid fill opening for putting a fluid such as water in the mat.

Figure 1:
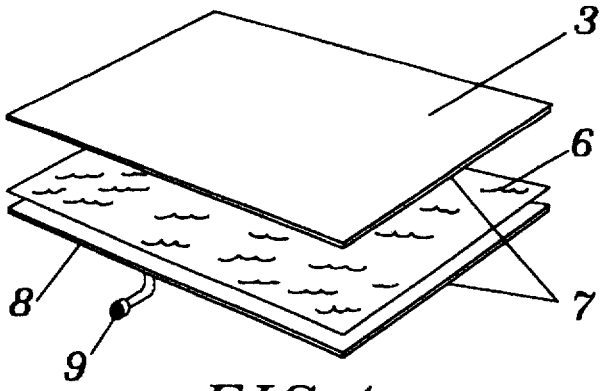
FIG. 1 illustrates an exploded view of the elements of the mat.
Figure 2:
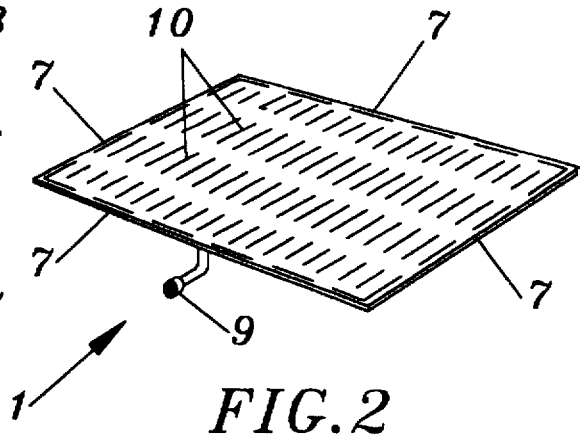
FIG. 2 illustrates a perspective view of the mat.
Figure 3:
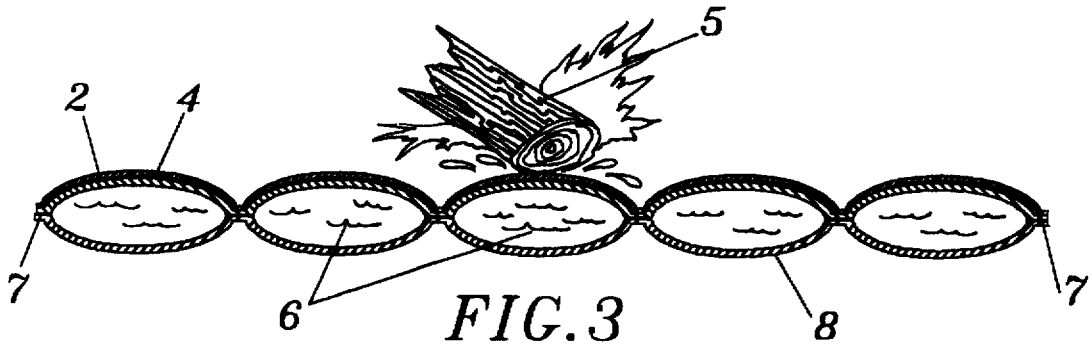
FIG. 3 illustrates a cross-section view of the mat with burning material on the semiporous surface.

Referring to FIG. 1 through 3, the mat (1) may be formed from two layers of material. One layer is a protective layer (2) which is a fabric with semiporous qualities such as cotton, flax, hemp, polyester, acrylic, modified acrylic, combinations of such fabrics and the like. The outer surface (3) of the protective layer (2) is coated with a semiporous coating (4) which is fire and heat resistant such as thermoplastic polyvinyl chloride resin finely dispensed in a liquid plasticized base, commonly known as plastisol. Other types of sealing materials include rubber butyl solids and water wood seals and paints.

The semiporous coating (4) has the characteristics of sealing the protective layer (2) material under normal ambient conditions such that fluid (6) does not leak from the mat (1). When the temperature is elevated such as when burning material (5) contacts the semiporous coating (4), some fluid (6) escapes the mat (1) by capillary action through the semiporous materials.

The mat (1) in its basic form is assembled by sealing, sewing, weaving or similarly attaching at the edges (7) the protective layer (2) and a container layer (8). A fluid fill connector (9) is provide at an edge (7) or in the container layer (8) to provide a means to introduce fluid into the mat (1). The normally available fluid for firefighting is water. The porous properties of the protective layer (2) and semiporous coating (4) would be designed to work with water in such a circumstance.

Prior to applying the semiporous coating (4) to the protective layer (2), the protective layer (2) and container layer (8) are sectioned by attaching the layers at discrete points. This may be accomplished by stitching (10) or sealing intermediate the edges (7) as illustrated in FIG. 2. This creates joined sections which do not separate under pressure of fluid introduced into the mat (1). The sectioning does not completely seal areas of the mat (1). This allows fluid (6) to be introduced into all areas of the mat (1) from one fluid connector (9).

Figure 4:
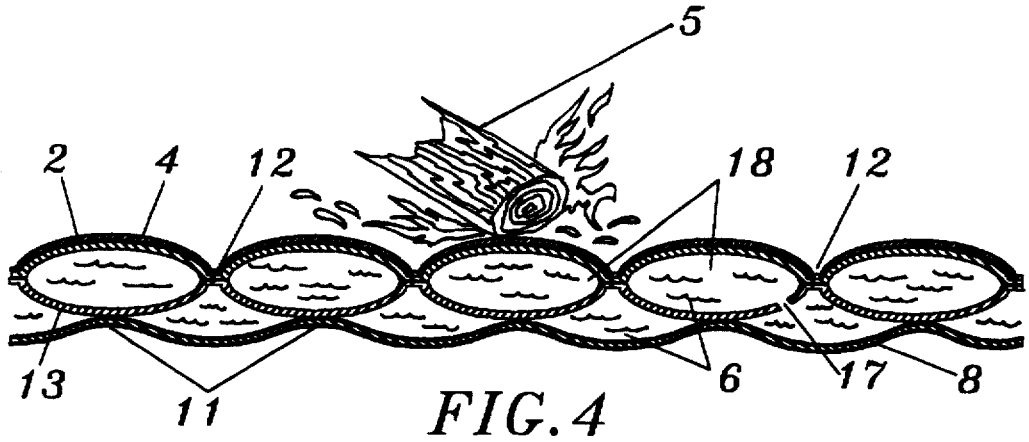
FIG. 4 illustrates a cross-section view of a three layer mat.

Once the sectioning is complete the semiporous coating (4) is applied which serves to also cover and protect any stitching (10) or similar attachment means. While two layers of material are illustrated in the preferred embodiment other configurations are also possible. As an example three layers of material may be used wherein the added layer attachment for sectioning would be staggered relative to the first two layers as illustrated in FIG. 4. Using this configuration the first stitched sections (11) are insulated from any burning material (5) by the second stitched sections (12) and the third layer (13) of material.

In an alternate embodiment for use of the mat (1) under conditions where attention as to which side of the mat (1) is exposed to the protective cannot be guaranteed, the container layer (8) may be replaced with a second protective layer (2) having a semiporous coating (4). In this configuration either side of the mat (1) when exposed to burning material (5) would act to retard a protective.

It has been found by experiment with a prototype mat (1) of dimensions approximately 3 feet by 4 feet, that water usage with burning coals on the mat (1) is minimized. The prototype mat (1) was filled with 14 cups of water. Burning coals were placed on the mat (1) and the coals were extinguished by the escaping water. The container layer (8) became cool during the capillary process which extinguished the coals. The semiporous coating (4) of plastisol resealed itself after the protective was extinguished. It was found that 6 cups of water were used during the experiment. The stitching (10) for the sectioning of the mat (1) was done longitudinally with approximately 1½ inches separation between lines of stitch seams.

Figure 5:
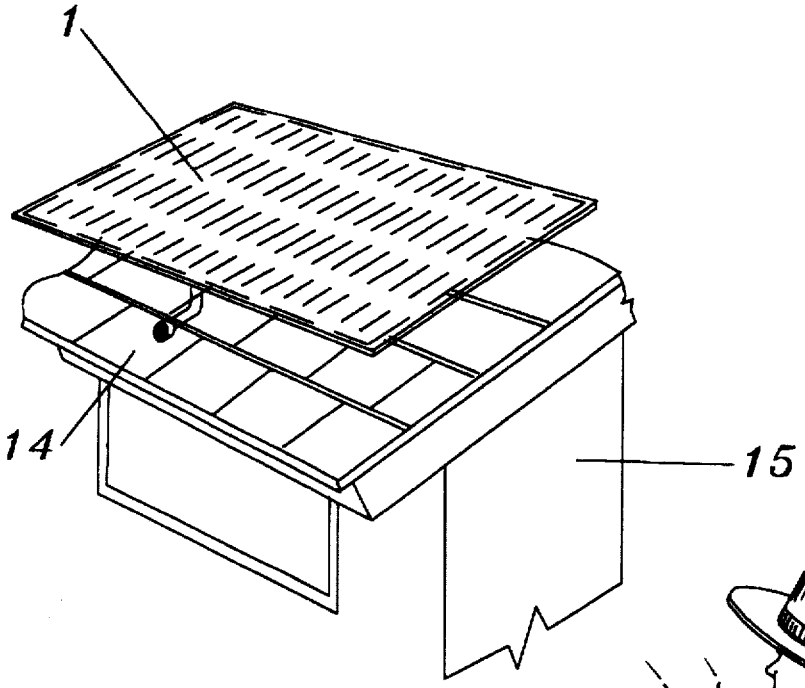
FIG. 5 illustrates the mat being placed on the roof of a structure for protection of the structure.
Figure 6:
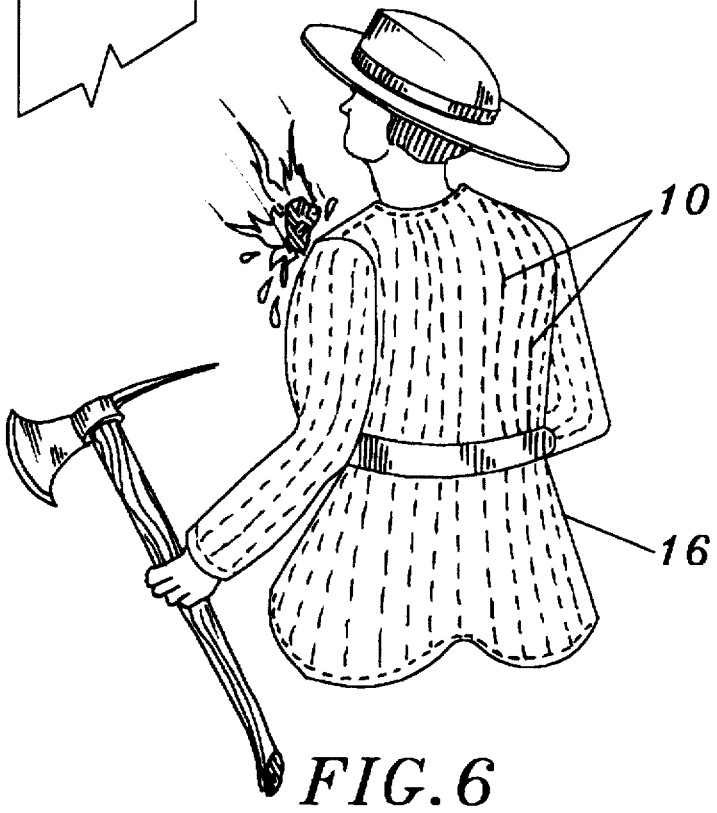
FIG. 6 illustrates the mat fashioned as a protective coat for a firefighter.

Referring to FIGS. 5 and 6, a mat (1) is illustrated for deployment on the roof (14) of a structure (15). A mat (1) constructed in the shape of a protective coat (16) for wear by a firefighter is illustrated in FIG. 6.

I claim:

1. A device for protection from protective and burning materials comprising:

a fire-retardart mat formed from a protective layer sealed at an edge to a container layer;

the protective layer composed of a semiporous material and on an outer surface having a semiporous coating wherein the semidorous material and the semiporous coating are not permeable for fluid under ambient environmental conditions and are permeable for fluid when the temperature of the environment is elevated to a determined temperature level; and the mat having a fluid fill connector with the mat filled with fluid.

2. The device as in claim 1 wherein the container layer and the protective layer are joined intermediate the edges by means of stitching.

3. The device as in claim 1 wherein:

a third layer composed of a semiporous material is sealed to the edges of the mat;

the third layer is joined intermediate the edges at a plurality of discrete points to the protective layer;

the third layer on an outer surface having a semiporous coating; and the third layer having an aperture defined therein to allow the fluid to fill a space between the protective layer and the third layer.

4. The device as in claim 1 wherein the mat is formed in the shape of a coat for wearing by a person.

5. The device as in claim 1 wherein the container layer and the protective layer are joined intermediate the edges at a plurality of seams which are spaced with approximately 1½ inches separation.

6. The device as in claim 1 wherein the container layer is replaced by a second protective layer composed of a semiporous material and on an outer surface having a semiporous coating.

7. The device as in claim 6 wherein the protective layer and the second protective layer are joined intermediate the edges by means of stitching.

8. The device as in claim 6 wherein the semiporous coating is plastisol.

* * * * *